US007399039B2

(12) United States Patent
Bettermann et al.

(10) Patent No.: US 7,399,039 B2
(45) Date of Patent: Jul. 15, 2008

(54) BASEPLATE PLOW GUIDE SECTION

(75) Inventors: Diedrich Bettermann, Unna (DE); Klaus Duhnke, Bochum (DE); Norbert Hesse, Bochum (DE); Gerhard Siepenkort, Lünen (DE); Adam Klabisch, Dortmund (DE)

(73) Assignee: DBT GmbH (DE)

( * ) Notice: Subject to any disclaimer, the term of this patent is extended or adjusted under 35 U.S.C. 154(b) by 3 days.

(21) Appl. No.: 11/548,895

(22) Filed: Oct. 12, 2006

(65) Prior Publication Data

US 2007/0205007 A1 Sep. 6, 2007

(30) Foreign Application Priority Data

Oct. 12, 2005 (DE) ..... 10 2005 049 318

(51) Int. Cl.
*E21C 27/34* (2006.01)

(52) U.S. Cl. ..... 299/34.1

(58) Field of Classification Search ..... 299/34.1
See application file for complete search history.

(56) References Cited

U.S. PATENT DOCUMENTS 7,188,441 B2 12/2004 Merten et al.

2006/0244302 A1* 11/2006 Siepenkort et al. ..... 299/34.1

FOREIGN PATENT DOCUMENTS

DE 37 10925 A1 10/1988
DE 42 33 840 A1 4/1994

* cited by examiner

*Primary Examiner*—John Kreck
(74) *Attorney, Agent, or Firm*—Baker & McKenzie LLP

(57) ABSTRACT

A baseplate plow guide section for guiding a baseplate plow. The baseplate plow guide section includes a guide element arranged on a packing side of a conveyor trough delimited by lateral profiles and a return trough delimited by trough profiles of a conveyor. The guide element has an upper chain channel and a lower chain channel provided with a guide slot for the plow baseplate. Reception pockets for toggle heads of connecting toggles for connection of adjacent baseplate plow guide sections are formed on the guide element. The guide element includes a casting which extends over a length of the baseplate plow guide section and on which the reception pockets and/or the packing-side trough profile of the return trough and/or a guide part for the plow baseplate of the baseplate plow are cast as integral components.

15 Claims, 2 Drawing Sheets

BASEPLATE PLOW GUIDE SECTION

CROSS-REFERENCE TO RELATED APPLICATION

This application claims priority to German Patent Application No. 102005049318.1 filed on Oct. 12, 2005.

The invention relates to a baseplate plow guide section for guiding a chain-drawn baseplate plow, with a guide element which is arranged on the packing side of a conveyor trough, delimited by lateral profiles, and of a return trough, delimited by trough profiles, of a conveyor and has an upper chain channel and a lower chain channel provided with a guide slot, open toward the working face, for the passage of a plow baseplate and to which at least one covering element for closing an inspection port for the two chain channels can be fastened releasably, with a connection bracket, arranged on the guide element, for a boom cylinder, and with reception pockets for toggle heads of connecting toggles for the tension-resistant connection of adjacent baseplate plow guide sections.

On baseplate plow guides, only baseplate plows with a baseplate engaging under the conveyor trough of the mining apparatus can be guided, since the strands of the plow chain are guided in chain channels running on the packing side of the conveyor trough. Baseplate plows are used particularly in the mining of seams with low thickness of less than 600 mm to about 1500 mm.

A baseplate plow guide with generic baseplate plow guide sections is known from DE 42 33 840 A1 and consists of a welded structure with individual elements which are welded to one another and to which at least the covering bonds are fastened releasably by means of fastening screws. The two chain channels are separated from one another by means of a sliding spacer piece which is welded to a planar vertically rising side plate of a conveyor trough and of which the top side and underside are of planar and flat design. The covering hoods form, with lower leg estensions, portions of the bottom of the lower chain channel, in which the baseplate of the baseplate plow is guided by means of the block and is connected to the tension strand of a plow chain. A similar baseplate plow guide, likewise designed as a welded structure, is known from DE 37 10 925 A1.

On account of the multiplicity of weld seams to be applied, the mounting of the baseplate plow guide sections is time-consuming and susceptible to deviations in position of the individual parts with respect to one another, as a result of which the service life or lifetime of generic baseplate plow guide sections may be reduced.

The object of the invention is to provide baseplate plow guide sections for a baseplate plow guide, which can be manufactured economically and which, in operational use, have long service lives and low susceptibility to wear.

This and further objects are achieved, according to the invention, in that the guide element consists of a casting which extends over the length of the baseplate plow guide section and on which the reception pockets and/or the packing-side trough profile of the return trough and/or of at least one guide port for the baseplate of a baseplate plow are cast as integral components. By the guide element being produced as a casting with cast-on reception pockets, a cast-on trough profile and/or a cast-on guide port, numerous welding steps which are absolutely necessary in the case of the generic plow guide sections can be saved. At the same time, welding edges in the running direction of the baseplate plow or of the plow baseplate are avoided, which, in the case of welded structures, may be subject to additional increased wear, for example on account of manufacturing inaccuracy.

According to a preferred refinement, the two reception pockets cast on the guide element are designed differently, and one of the reception pockets has a widening for receiving a toggle securing element. By the choice of suitable toggle securing elements, a preferably positive securing of a connecting toggle in the reception pockets of adjacently arranged baseplate plow guide sections can then be achieved at comparatively low outlay in mounting terms, the plow guide sections. The integral formation of the reception pockets on the guide element at the same time in this case ensures dimensional stability and positional accuracy between the reception pockets which, in the mounting state, lie adjacently and receive a connecting toggle.

According to a further advantageous refinement, the covering element consists of a hood produced as a casting and having a cast-on nose which in the region of the inspection port forms a portion of the upper chain channel. It is particularly advantageous in this case if the upper chain channel in the guide element has, in the region of the inspection port, a cast-on bottom leg which extends toward the packing side beyond the center of the chair channel and causes the plow chain to be supported even when the hood is demounted. Owing to this corresponding configuration of the cast-on bottom leg, even with the hood removed, a support of the plow chain laid in the upper chain channel can be achieved. At the same time, the plow chain is easily accessible, since the hood with the cast-on nose releases the inspection port both with regard to the lower chain channel and with regard to the upper chain channel of comparatively large cross section, so that mounting operations on the chain links are possible more effectively than hitherto. Furthermore, in the case of a casting, the outer surfaces of the bottom leg which face the lower and the upper chain channel respectively may in each case be designed with curved surfaces in order to improve the guidance of the chain strands.

According to a refinement which is also advantageous, screw receptacles for hood fastening screws are cast on the top side of the guide element. According to an advantageous refinement according to the invention, the guide elment may have a cast-on bottom part which forms a packing-side running surface, extending over the length of the guide element, for the plow baseplate or baseplate of a baseplate plow. The running surface consequently forms a continuous part, preferably cast on according to the invention, on the guide element. It is particularly advantageous if the guide element is provided in the region of the inspection port with supporting legs for the hood which are cast, upright, on the bottom part. Owing to the integral configuration of the supporting legs and of the screw receptacles, a simple and at the same time extremely stable fastening of the hood is achieved.

Preferably, further, the bottom part cast on the guide element may form with its working face-side end a scraping edge formed below and so as to be spaced apart from the cast-on trough profile. This, too, improves the running behavior of a plow baseplate guided in the lower chain channel via corresponding blocks, the scraping edge also extending continuously and without a weld seam or the like over the entire length of the guide element and consequently of the baseplate plow guide section. Neckings, on which rocker elements with a convexly curved bottom are cast or preferably welded, may be cast on the underside of bottom part in order to improve the movement behavior of the baseplate plow guide during actuations of the boom control. Particularly in the case of an adjustment of the cutting horizon, that is to say a change in the angle of inclination of the baseplate plow guide with respect to the working face, the rockers may serve as a packing-side support of the baseplate plow guide on the footwall. At the same time, the rocker elements, advantageously arranged only at a distance from one another, reduce the overall weight of the guide elements and consequently of the baseplate plow guide sections.

According to a further advantageous refinement, the cast-on trough profile, delimiting the return trough for the scrapers of the scraper chain on the packing side, may form with its top side a supporting edge for supporting a conveyor trough element having the lateral profiles and the working face-side trough profile. The conveyor trough element preferably forms a part welded on the guide element, in which case intimate welding between the two part elements can be achieved on account of the support of the conveyor trough element over the entire length of the guide element. The conveyor trough element is preferably designed as a welded part with lateral profiles welded on the conveyor bottom, with welded-on reception pockets and with a welded-on working face-side trough profile which, together with the trough profile cast on the guide element, forms or laterally delimits the return trough for the scrapers of the conveyor. According to a further advantageous refinement, the conveyor trough element may be provided on the working-face side with a welded-on ramp which covers the working face-side trough profile and the working face-side lateral profile and which, on the one hand, forms a loading ramp for broken material during the forward pushing of the baseplate plow guide and, at the same time, may form a working face-side guide at the plow body on the baseplate plow guide. It is particularly advantageous if the ramp has an angling between a lower, steeper ramp portion and an upper, flatter ramp portion, in order to improve the double function of the ramp and at the same time, by virtue of the upper, flatter ramp portion, to counteract an unwanted climbing of the baseplate plow guide during the forward pushing of the baseplate plow guide.

According to a particularly advantageous refinement, identically designed connecting toggles are inserted into the packing-side reception pockets cast on the guide element and into the reception pockets welded on the conveyor trough element. By means of identical toggles used both on the working-face side and on the packing side, the stock of corresponding toggles on the longwall can be considerably minimized and, at the same time, the procurement of replacement parts can be simplified. According to a particularly advantageous refinement of independent inventive significance, the same toggles may also be used as connecting parts for the individual baseplate parts of a multipart plow baseplate.

Preferably, further, the connection bracket, having a joint socket for the articulated reception of a head of a boom cylinder, may be designed in two parts and comprise a basic body which is welded to the guide element and has an integral first part socket and to which a closing piece with a second part socket is fastened releasably via a screw connection. Consequently, where the connection bracket is concerned, the already known welding-on of a multipart connection bracket can be adopted, with the result that the production of the guide element as a casting is facilitated.

Further advantages and refinements of the invention may be gathered from the following description of an exemplary embodiment of a baseplate plow guide section according to the invention, as shown diagrammatically in the drawing in which.

Figure 1:
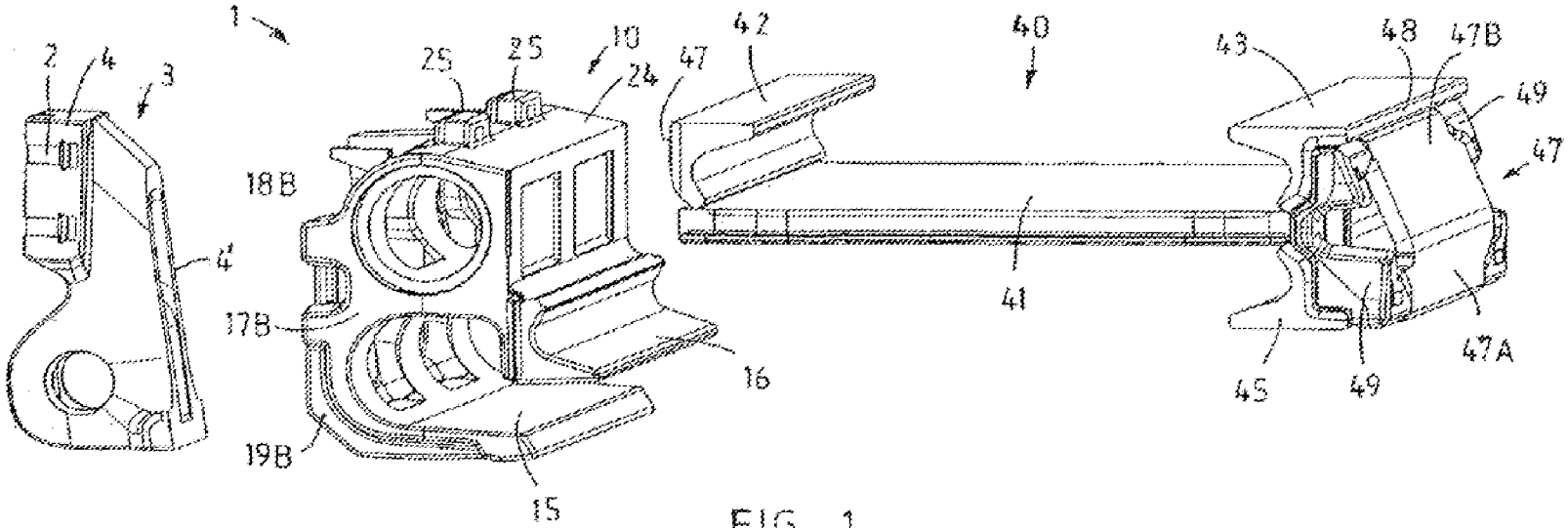
FIG. 1 shows in perspective an exploded illustration of the main components of a baseplate plow guide section according to the invention.

The baseplate plow guide section, designated as a whole by 1 in the figures, can be assembled together with further identically designed baseplate plow guide sections to form a baseplate plow guide with an integrated conveyor. Each baseplate plow guide section 1 consists of a guide element 10 which is produced as a casting and to which a conveyor trough element 40 produced as a welding structure and having weld-on surfaces lying on the packing side is welded on that side of the guide element 10 which faces the working face. Furthermore, each baseplate plow guide section 1 comprises a multipart connection bracket 3 with the articulated reception of the head of a boom cylinder, not illustrated, buttressed on a rear arm. For this purpose, the connection bracket 3 comprises a basic body 4 welded to the guide element 10 and a closing piece 5 which could be screwed releasably to said basic body via screw conditions 2, of which part sockets in the basic body 4 and in the closing piece 5 form a joint socket for receiving a head of the boom cylinder, not illustrated.

The construction of the guide element 10, then, is explained first with reference to FIGS. 1 to 5. The guide element 10 consisting of a casting has integrally an upper chain channel 12, already formed during the casting process and closed with the exception of inspection ports 11, and a lower chain channel 13 which, on the side lying opposite the inspection ports, has a continuous guide slot 14 for the passage of a plow baseplate of a baseplate plow, not illustrated. In operational use, the guide slot 14 points toward the working face or coal face, while the inspection ports 14 point toward the packing side. This terminology therefore refers below, in part, to the working-face side or the packing side. Furthermore, the guide element 10 has cast on it integrally a bottom part 15, which extends over the length of the guide element 10 and which forms a lower packing-side running surface for the packing-side end of the plow baseplate, and a trough profile 16, which extends over the length of the guide element 10 and which , as will also be explained, forms a lateral guide for scrapers in a return trough of a chain scraper conveyor. The underside 16' and the top side 15', forming the running surface, of the bottom part delimit the guide slot 14 for the passage of the plow baseplate and the working side-face end of the bottom part forms a scraping edge 36 for the plow baseplate. The rear side 16" of the trough profile 16 on the guide element 10 forms at the same time a sliding guide for a packing-side block on the plow baseplate, not illustrated.

Within the lower chain guide channel 13, a plow pull chain, not illustrated, is connected with its tension strand, on the packing side, to the plow baseplate of the baseplate plow, while the return strand of the plow pull chain runs in the upper chain channel 12. In order to protect the upper chain channel 12 against an excessive penetration of fine coal, a centering ring 18A projects concentrically with respect to the guide channel 12 on one end face 17A of the guide element and fits into a suitably designed annular receptacle 18B on the other end face 17B of the guide element 10. For the lower chain guide channel 13, a projecting lip 19A is cast in a corresponding configuration on one end face 17A and on the other end face 17B engages under a suitably designed stepped necking 19B, in order by overlapping to achieve a gap covering of the connecting joint between two adjacent baseplate plow guide sections 1. As shown particularly in FIG. 2, the trough profile 16 cast on the guide element 10 also projects slightly beyond the end face 17A, so that, also where the trough profile 16 is concerned, an overlap is obtained at the connecting joint between two adjacent guide sections 1.

Figure 5:
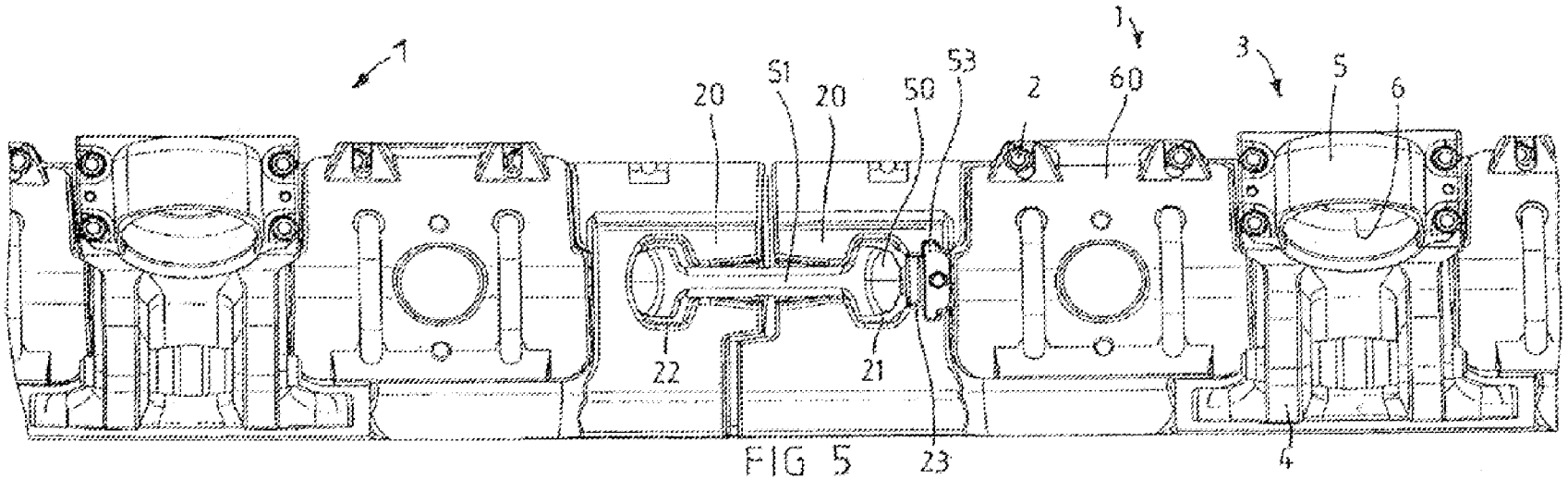
FIG. 5 shows, in a view of the packing-side rear side, two baseplate plow guide sections connected by means of a connecting toggle.
Figure 2:
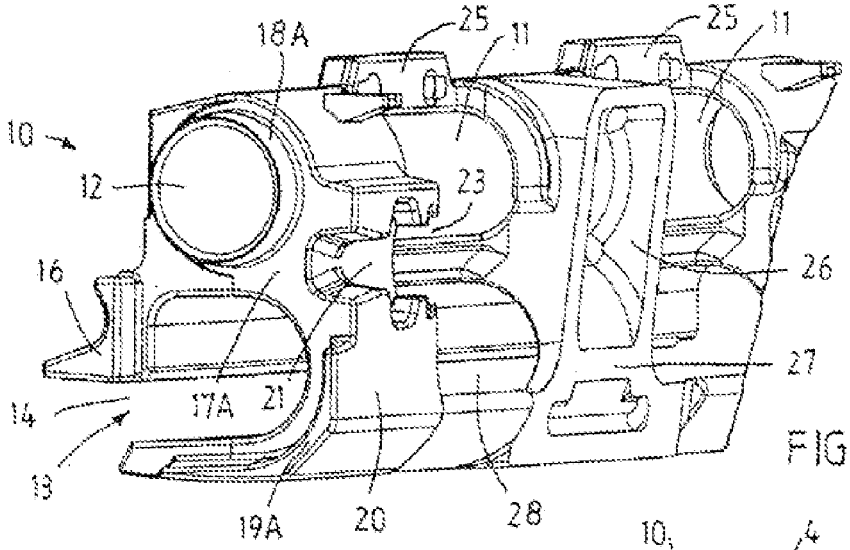
FIG. 2 shows in perspective a part view of the packing-side rear side of the guide element.

Cast integrally on the guide element 10, in a packing-side rear wall portion 20, is a first reception pocket 21 in which a toggle head 50 of a connecting toggle 51 fits essentially positively for the tension-resistant fastening, angularly movable to a limited extent, of two adjacent baseplate plow guide sections 1, as can be seen clearly in FIGS. 2 and 5. On the other end face of the guide element, a further reception pocket 22 of deviating geometry is cast integrally in the rear side 20. Only the reception pocket 21 has toward the pocket rear side a widening 23 into which a securing element 53 is inserted releasably for securing the connecting toggle 51 fitting with its toggle heads into the two reception pockets 21, 22. The reception pocket 21 is therefore open toward the rear side, while the reception pocket 22 is closed on the rear side.

Figure 6:
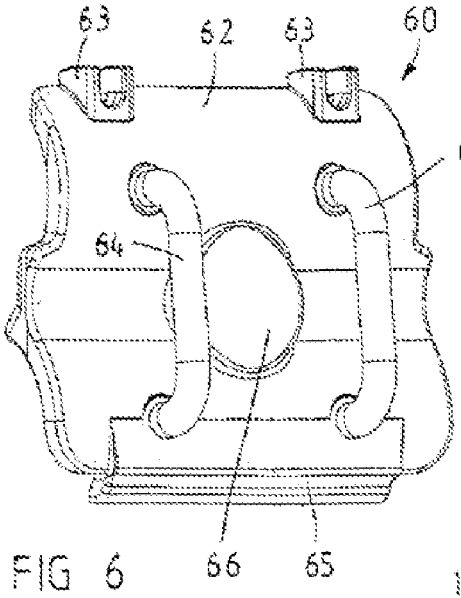
FIG. 6 shows in perspective a hood according to the invention for closing the inspection port.
Figure 4:
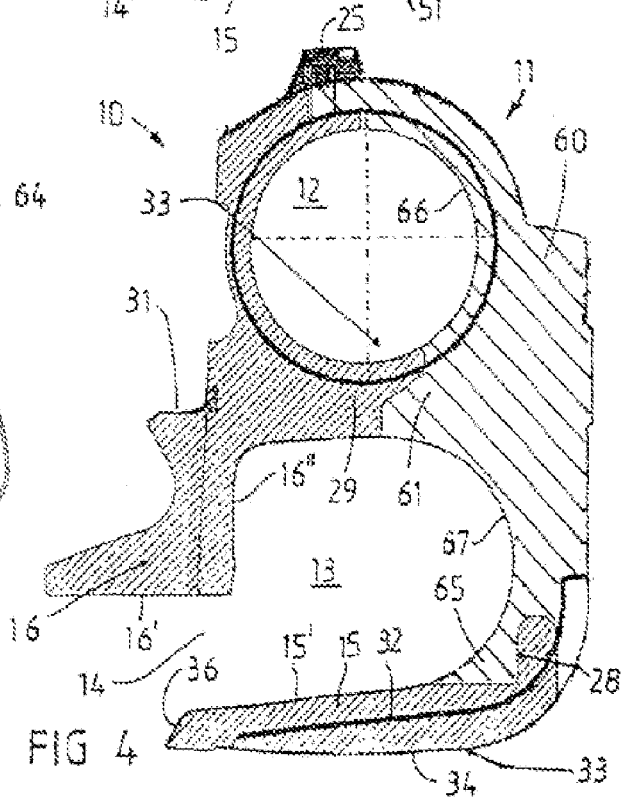
FIG. 4 shows diagrammatically a vertical section through the inspection port of the guide element with an inserted hood.

Screw receptacles are cast integrally on the top side 24 of the guide element 10. The inspection ports 11 are in each case closed by means of a hood 60 which extends both over the upper chain channel 12 and over the lower chain channel 13 of a guide element 10 and which is illustrated in FIG. 4 to 6.

On account of the cast-on screw receptacles 25, the hood 60 can be fastened to the guide element 10 in a comparatively simple way. Between the two inspection ports 11, the guide element 10 has a box-shaped connecting surface 27, provided with weight-reducing recesses 26, for welding on the basic body 4 of the connection bracket 3. Both the connecting surface on the guide element 10 and the associated connecting surface 4' on the rear side of the basic body 4 extend rectilinearly over the height of the guide element 10 or of the basic body 3. Furthermore, the guide element 10 has formed on it in the region of the two inspection ports 11, in each case on the transition of the bottom part 15 to the inspection port 11, a cast-on supporting leg 28 in order to support the hood 60 on the lower edge of the inspection port 11 by means of a projection formed integrally on the guide element 10. For delimiting the upper chain channel 12 on the bottom side in the region of the inspection port 11, the guide element 10 is provided above the cast-on trough profile 16 with a cast-on bottom leg 29 which extends toward the packing side beyond the center of the chain channel 12 and of which the free leg edge 30 provided with a step cooperates with a nose 61 projecting on the inside of the hood 60 and having a complementary step. The hood 60 is therefore advantageously likewise produced as a casting with an integral nose 61. Furthermore, the hood 60 has produced on it, on the top side 62, integrally formed straps 63 for the hood fastenings, on the rear side, integrally formed grips 64 and, at the lower edge, an integrally formed supporting strip 65. The hood 60 may be produced as a casting in such a way that, at a central point, a casting funnel 66 is provided, which, although being worked off when the hood 60 is in use, has nevertheless not been removed completely, so that the individual parts on the hood 60 can be shaped during casting. On the inside having the nose 61, the hood 60 has for each of the two chain channels 12, 13 a guide half shell 66 and 67 which, in the mounting state of the hood 60, closes off the chain channel 12 and 13 toward the packing side in terms of a running capacity of the chain strands which has minimized wear.

Figure 3:
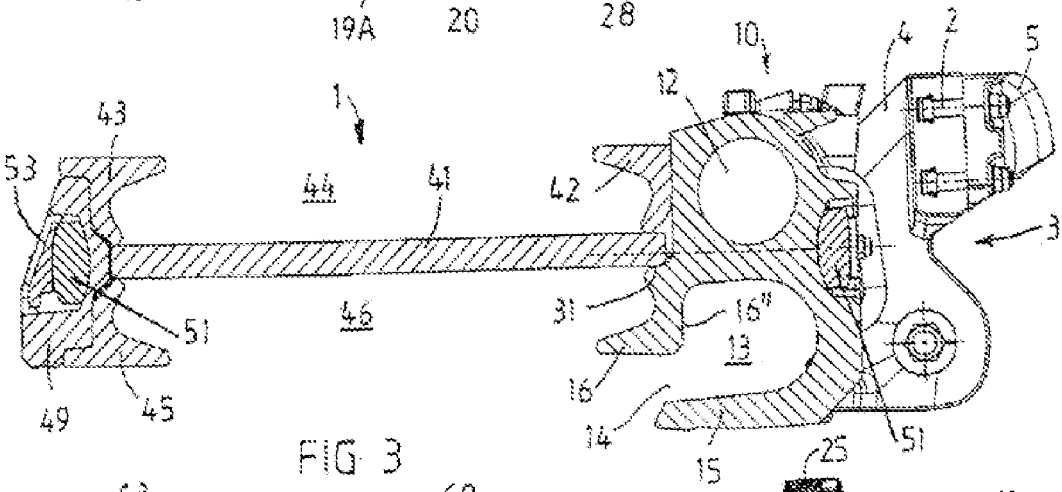
FIG. 3 shows a partially sectional side view of the baseplate plow guide section according to the invention.

Moreover, in order to form a baseplate plow guide section 1 by means of the guide element 10, a conveyor trough element 40 which, as shown in FIGS. 1 and 3, is composed of a welded structure, is welded on the working-face side. It has a conveyor bottom 41, to the top side of which a packing-side lateral profile 42 and a working face-side lateral profile 43 are welded, in order with the two lateral profiles 42, 43 to delimit a conveyor trough 44 of the conveyor integrated into the baseplate plow guide. The scraper ends of a scraper, running in the conveyor trough 44, of a scraper chain are in this case guided on mutually facing and correspondingly shaped insides of the two lateral profiles 42, 43. A working face-side trough profile 45 is welded to the underside of the conveyor bottom 41, in order, together with the trough profile 16 cast on the guide element 10, to form a downwardly open return trough 46 for the scraper chain. The conveyor bottom 41 is laid with the packing-side edge, formed below the packing-side lateral profile 42, onto the trough profile 16 cast on the guide element 10 and having a continuously flat top side 31, with the result that said trough profile consequently forms a supporting edge for the conveyor trough element 40. A stable welded connection between the conveyor trough element 40 and the guide element 10 can be achieved via weld seams between the conveyor bottom 41 and the trough profile 16 and between the upper lateral profile 42 and the front surface of the guide element 10.

On the working-face side, the conveyor trough element 40 is provided with a ramp 47, shown in FIG. 1, which rises above the height of the conveyor trough element 40 and which covers the working face-side lateral and trough profiles 42, 45. The ramp 47 has, angled with respect to one another, a lower, steeply rising ramp portion 47A, on which the plow body can additionally be guided, and an upper, flatter-running ramp portion 47B, which rises as far as a top leg 48 of the packing-side lateral profile 43, in order to conduct broken material via the ramp 47 into the conveyor trough 44. Furthermore, pocket receptacles 49, into which connecting toggles can be inserted with their toggle heads, are welded on the working-face side, these connecting toggles preferably being designed identically to those connecting toggles 50 which are used on the packing side on the guide elements 10 of the baseplate plow guide sections 1.

All the individual elements of the baseplate plow guide section 1 according to the invention can be provided with weight-reducing neckings of clearances. Furthermore, the guide element 10 has formed on it on the underside a series of neckings 32 in which rocker elements 33 with a convexly curved underside can be inserted and welded. The two reception pockets 49, welded on the conveyor trough element 40, for the connecting toggles 51 may at the same also be welded to the working face-side lateral profile 43 and to the working face-side trough profile 45, in order additionally to stiffen the conveyor trough element 40. The positioning of the loading ramp 47 is preferably selected such that, in the mounting state, the steeper ramp surface 47A lies on the same plane as the guide surface 16" on the rear side of the trough profile 16 in the chain guide channel 13, so that the horizontal forces introduced from the plow body into the baseplate plow guide sections 1 lie opposite one another on one plane, and the tendency of the baseplate plow guide to endeavor to climb or to dip when a baseplate plow runs past decreases.

Numerous modifications which are to come within the scope of protection of the appended claims may be gathered from the foregoing description by a person skilled in the art. Depending on the application, individual elements of the guide element could also consist of separate components which are not cast on, but, instead, are welded on. The figures show only one preferred exemplary embodiment.

The invention claimed is:

1. A baseplate plow guide section for guiding a chain-drawn baseplate plow, comprising:

a conveyor trough;

at least one lateral profile located at an edge of the conveyor trough;

a return trough;

at least one trough profile located at an edge of the return trough;

a guide element located on a packing side of the conveyor trough and of the return trough;

an upper chain channel located in the guide element;

a lower chain channel located in the guide element;

a guide slot located in the guide element, the guide slot being operable for passage of a plow baseplate of the baseplate plow;

at least one inspection port located in the guide element, the inspection port being operable for inspection of the upper chain channel and of the lower chain channel;

at least one covering element releasably attached to the guide element and operable for closing the at least one inspection port;

a boom cylinder connection bracket located on the guide element;

at least one bottom guide part located on the guide element;

at least one reception pocket located on the guide element, the at least one reception pocket being operable for accepting a toggle head of a connecting toggle, wherein the guide element extends over a length of the baseplate plow guide section; and at least one of the at least one reception pockets, the at least one trough profile, or the bottom guide part is formed integrally with the guide element.

2. The baseplate plow guide section of claim 1, further comprising at least one adjacent baseplate plow guide section, wherein the at least one reception pocket on the baseplate plow guide section and a reception pocket located on the at least one adjacent baseplate plow guide section are not identical; and at least one of the at least one reception pocket on the baseplate plow guide section and the reception pocket located on the at least one adjacent baseplate plow guide section includes a widening portion operable for receiving a toggle securing element.

3. The baseplate plow guide section of claim 1, further comprising:

a hood detachably mounted on the at least one covering element; and a nose located on the hood, wherein the nose forms a portion of the upper chain channel adjacent to the inspection port.

4. The baseplate plow guide section of claim 3, further comprising:

a plow chain; and a bottom leg located on the upper chain channel adjacent to the inspection port, wherein the bottom leg projects toward the packing side and beyond a center of the chain channel; and the bottom leg is operable for supporting the plow chain when the hood is not mounted to the at least one covering element.

5. The baseplate plow guide section of claim 1, further comprising at least one screw receptacle located on a top side of the guide element, the at least one screw receptacle being operable for accepting at least one hood fastening screw.

6. The baseplate plow guide section of claim 3, wherein the bottom guide part forms a packing-side running surface and extends over the a length of the guide element.

7. The baseplate plow guide section of claim 6, further comprising at least one supporting leg located on the guide element adjacent to the inspection port, wherein the at least one supporting leg is operable for supporting the hood.

8. The baseplate plow guide section of claim 6, further comprising a scraping edge located on the bottom guide part, wherein the scraping edge is located on a working face-side of the guide element; and the scraping edge is formed below the trough profile and spaced apart from the trough profile by a predetermined distance.

9. The baseplate plow guide section of claim 6, further comprising:

at least one necking element; and at least one rocker element located on a bottom side of the bottom guide part, the at least one rocker element including a convexly-curved bottom surface.

10. The baseplate plow guide section of claim 1, further comprising:

a conveyor trough element; and a supporting edge formed on a top side of the at least one trough profile, the supporting edge being operable for supporting the conveyor trough element, wherein the conveyor trough element includes the at least one lateral profile and the at least one trough profile.

11. The baseplate plow guide section of claim 10, further comprising:

at least one reception pocket located on the conveyor trough element;

at least one lateral profile located on the conveyor trough element; and at least one working-face side trough profile located on the conveyor trough element.

12. The baseplate plow guide section of claim 11, further comprising a ramp located on a working-face side of the conveyor trough element, wherein the ramp covers the workingface side trough profile and the at least one lateral profile.

13. The baseplate plow guide section of claim 12, wherein the ramp includes a lower steep ramp portion and an upper flat ramp portion.

14. The baseplate plow guide section of claim 1, further comprising at least one connecting toggle, the at least one connecting toggle being located within the at least one reception pocket.

15. The baseplate plow guide section of claim 1, wherein the connection bracket further comprises:

a basic body attached to the guide element;

a first socket part located on the basic body; and a closing piece including a second socket part, wherein the closing piece is releasably attached to the basic body to form a boom cylinder joint socket.

* * * * *